United States Patent [19]

Nagase et al.

[11] Patent Number: 4,481,867

[45] Date of Patent: Nov. 13, 1984

[54] AXIAL PLUNGER PUMP OR MOTOR

[75] Inventors: Yukihiko Nagase; Tetsuo Kawasaki, both of Nagoya; Masato Hiromatsu, Tokyo; Sadao Asanabe; Kunio Saki, both of Nagasaki, all of Japan

[73] Assignee: Mitsubishi Jukogyo Kabushiki Kaisha, Tokyo, Japan

[21] Appl. No.: 401,979

[22] Filed: Jul. 26, 1982

[30] Foreign Application Priority Data

Jul. 28, 1981 [JP] Japan ..... 56-111004[U]

[51] Int. Cl.[3] ..... F01B 13/04

[52] U.S. Cl. ..... 91/487; 91/499

[58] Field of Search ..... 91/487, 499, 488

[56] References Cited

U.S. PATENT DOCUMENTS

| | | | |
|---|---|---|---|
| 2,033,464 | 3/1936 | Ferris | 91/487 |
| 3,183,846 | 5/1965 | Skinner | 91/499 |
| 3,776,103 | 12/1973 | Gunnar | 91/487 |
| 3,899,880 | 8/1975 | Rohs | 91/499 |
| 4,007,663 | 2/1977 | Nagatomo | 91/487 |

FOREIGN PATENT DOCUMENTS

| | | | |
|---|---|---|---|
| 822014 | 10/1959 | United Kingdom | 91/499 |

*Primary Examiner*—William L. Freeh

*Attorney, Agent, or Firm*—Wenderoth, Lind & Ponack

[57] ABSTRACT

An axial plunger pump or motor of the type such that a valve plate having a suction port and a discharge port drilled therein is fixed to a casing in which a rotary shaft is mounted. A cylinder block having one end surface opposed to the valve plate is coupled to the rotary shaft. A plurality of bores whose one ends can be communicated with the suction port and the discharge port are drilled in the cylinder block in parallel to the rotary shaft. A plurality of plungers, which can reciprocate within the respective bores in accordance with rotation of the rotary shaft are slidably fitted in the bores on the side of the other ends. A seal plate positioned between the valve plate and the cylinder block and making slide contact with the valve plate is coupled to the rotary shaft. A plurality of bushes or bushings, each consisting of a thin-walled cylinder portion fitted in one end portion of the bore and capable of making tight contact with an inner wall surface of the bore as expanded in diameter by a high-pressure liquid within the bore and a flange portion butting against the seal plate, are interposed between the seal plate and the cylinder block. An urging member for bringing the flange portion of the bush into tight contact with the seal plate in cooperation with the high-pressure liquid is provided between the flange portion of the bush and the one end surface of the cylinder block.

3 Claims, 9 Drawing Figures

FIG.3
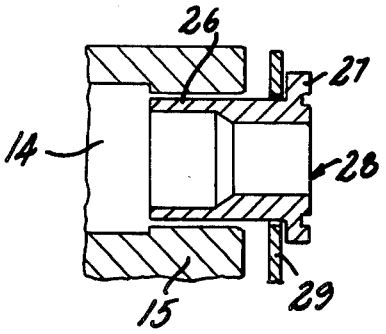
FIG.4
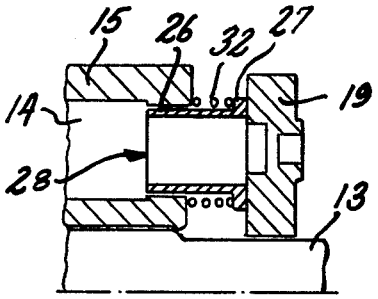
FIG.5
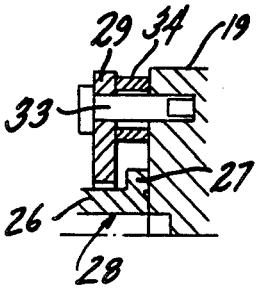
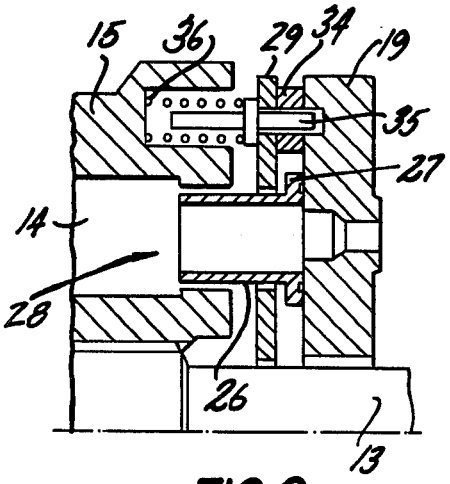
FIG.6
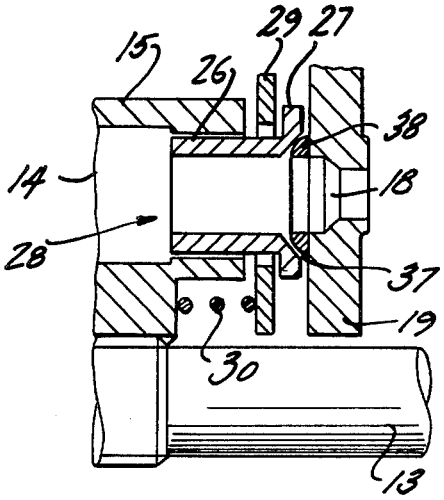
FIG.7

AXIAL PLUNGER PUMP OR MOTOR

BACKGROUND OF THE INVENTION

1. Field of the Invention

The present invention relates to an axial plunger pump or motor in which a sealing property of a sliding surface between a valve plate and a cylinder block has been improved.

2. Description of the Prior Art

An axial plunger pump or motor which sucks and discharges a liquid or drives a rotary shaft by making plungers reciprocate in parallel to a center axis of a cylinder block has a relatively high efficiency and little pulsation as compared with the other types of pumps or motors such as a gear pump or motor, a vane pump or motor, etc. But on the other hand since the number of parts is large and the structure is complex, it is necessary to enhance the machining precision of these parts. Moreover, due to the fact that a torque moment caused by a hydraulic pressure and a tilt associated with bending of a rotary shaft would be generated in a cylinder block and hence the cylinder block would unevenly butt against a valve plate, there was a fear that these members may be seized by each other or a high-pressure liquid may leak out through a clearance therebetween.

Therefore, various axial plunger pumps or motors with a contrivance made on a seal portion between a cylinder block and a valve plate have been developed. For instance, an improved structure is known, in which, between a valve plate 103 fixed to a casing 102 which supports a rotary shaft 101 and a cylinder block 104 fixedly fitted to the rotary shaft 101, there is interposed a seal plate 106 that is always urged against the valve plate 103 by a compression coil spring 105 as shown in FIG. 1(*a*). Sealing between a bore 108, in which a plunger 107 is fitted slidably in the direction parallel to the rotary shaft 101, and the seal plate 106 is effected by means of seal rings 111 which are mounted around a cylinder portion 109 of the seal plate 106 to be fitted in the bore 108 via a liner 110, as shown in FIG. 1(*b*) which illustrates in an enlarged scale the portion in FIG. 1(*a*) indicated by an arrow B. In the prior art, piston rings were used as the seal rings 111.

However, since the seal plate 106 having the above-described structure takes such configuration that its cylinder portions 109 are provided the same number as that of the bores 108 drilled in the cylinder block 104 in parallel to the rotary shaft 101 as projected in an annular array, the precision in position of these cylinder portions 109 is not so high, and necessarily the gap clearance between the inner diameter of the bore 108 and the outer diameter of the cylinder portion 109 must be chosen large. Accordingly, in order to enhance a durability of the cylinder portion 109, a wall thickness at this portion is made thick, and consequently, there is a shortcoming that a cross-section area of a liquid passageway within the cylinder portion 109 is reduced and hence a self-sucking performance is degraded. In addition, due to the fact that seal rings 111 are employed, a leaking rate of a high-pressure liquid through the engaging portions of the seal rings 111 becomes an unnegligible rate, and it becomes a cause of bringing about lowering of a volume efficiency.

SUMMARY OF THE INVENTION

It is therefore one object of the present invention to provide an axial plunger pump or motor, in which a sealing property between a cylinder block and a valve plate is greatly improved so that leakage of a high-pressure liquid through a clearance between these members may be minimized and the pump or motor may have an excellent self-sucking property.

According to one feature of the present invention, there is provided an axial plunger pump or motor of the type such that a valve plate having a suction port and a discharge port drilled therein is fixed to a casing in which a rotary shaft is mounted, a cylinder block having one end surface opposed to the valve plate is coupled to the rotary shaft, a plurality of bores whose one ends can be communicated with the suction port and the discharge port are drilled in the cylinder block in parallel to the rotary shaft, and a plurality of plungers which can reciprocate within the respective bores in accordance with rotation of the rotary shaft are slidably fitted in the bores on the side of the other ends. The improvement resides in that a seal plate, positioned between the valve plate and the cylinder block and making slide contact with the valve plate is coupled to the rotary shaft, a plurality of bushes or bushings, each consisting of a thin-walled cylinder portion fitted in one end portion of the bore and capable of making tight contact with an inner wall surface of the bore as expanded in diameter by a high-pressure liquid within the bore and a flange portion butting against the seal plate, are interposed between the seal plate and the cylinder block, and an urging member for bringing the flange portion of the bush into tight contact with the seal plate in cooperation with the high-pressure liquid is provided between the flange portion of the bush and the one end surface of the cylinder block.

BRIEF DESCRIPTION OF THE DRAWING

The above-mentioned and other features and objects of the present invention will become more apparent by reference to the following description of preferred embodiments thereof taken in conjunction with the accompanying drawings, wherein:

FIGS. 3 to 7 are enlarged cross-section views of the principal portions according to different modified embodiments of the present invention.

DETAILED DESCRIPTION OF THE PREFERRED EMBODIMENTS

Figure 1B:
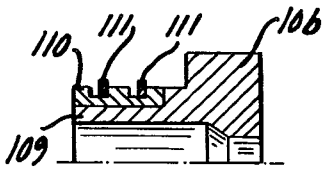
FIG. 1(b) PRIOR ART
FIG. 1(*a*) is a cross-section view showing an internal structure of an axial plunger pump in the prior art, FIG. 1(*b*) is an enlarged cross-section view of a portion indicated by an arrow B in FIG. 1(*a*), FIG. 2(*a*) is a cross-section view showing an internal structure of an axial plunger pump according to one preferred embodiment of the present invention, FIG. 2(*b*) is an enlarged cross-section view of a principal portion in the structure shown in FIG. 2(*a*)
Figure 1A:
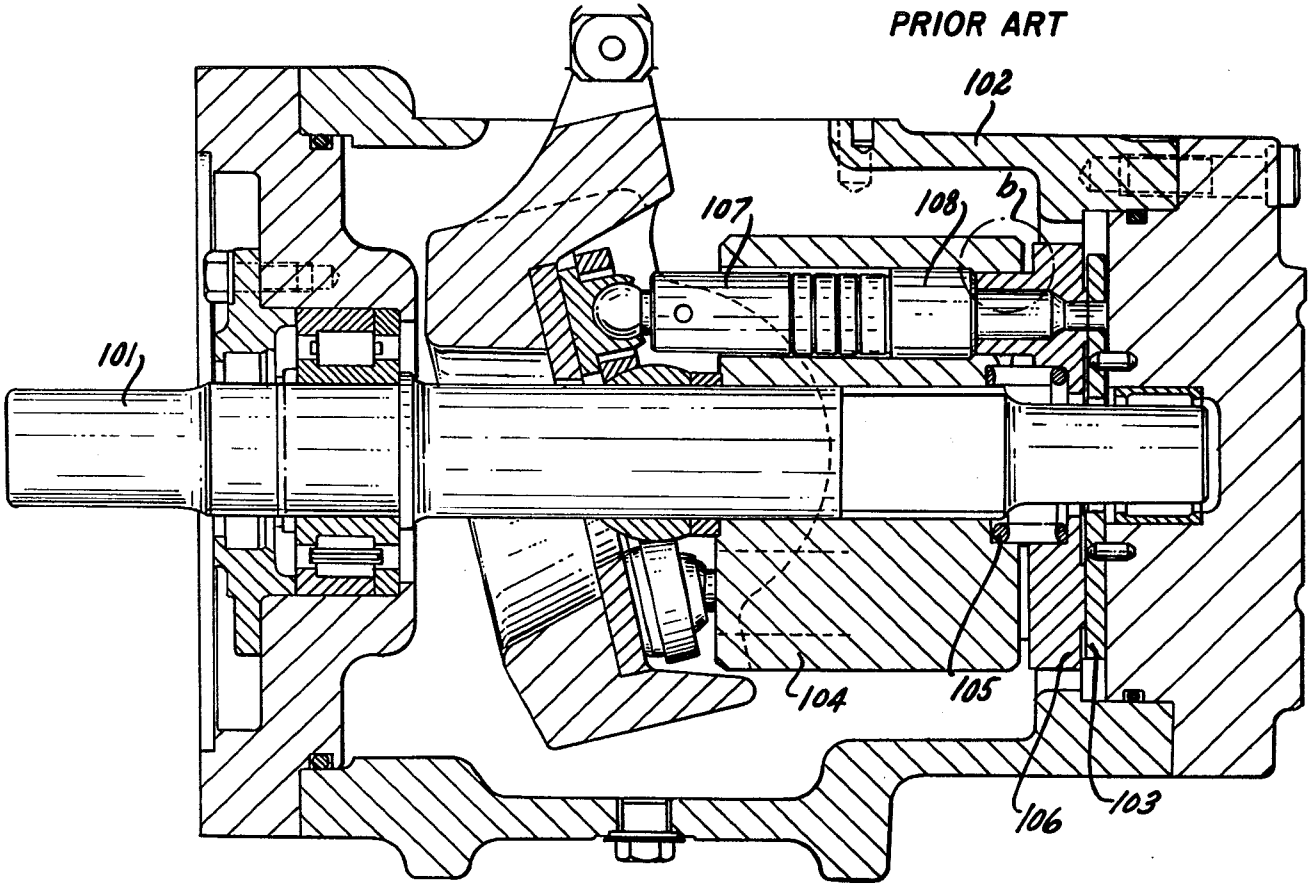
FIG. 1(a) PRIOR ART

Now, an axial plunger pump or motor according to the present invention will be described in greater detail in connection with one preferred embodiment of the invention as applied to a variable capacity tilt-plate type axial plunger pump with reference to FIG. 2(*a*) showing its internal structure in cross-section and FIG. 2(*b*) showing a bush portion in the structure in an enlarged scale. A cylinder block 15 having a plurality of bores 14 drilled therein in parallel to a rotary shaft 13, is integrally fixed to the rotary shaft 13, which is in turn mounted to a casing 12 via a pair of bearings 11 and coupled to a drive source not shown. Between this cylinder block 15 and a valve plate 17 integrally secured to the casing 12 and having a suction port 16 and a discharge port not shown drilled therein, there is positioned a seal plate 19 which makes slide contact with the valve plate 17 and has a plurality of bores 18 corresponding to the above-mentioned bores 14 drilled therein, and this seal plate 19 is coupled to the rotary shaft 13 via a key 20. One end of each of a plurality of plungers 24, slidably fitted respectively in one end portion of end of the bores 14, is coupled to a plurality of shoes 23 which make slide contact with a tilt-plate 22 that is tiltably supported from the rotary shaft 13 via a spherical seat 21, and these shoes 23 have their distances from the center of the spherical seat 21 located on the center axis of the rotary shaft 13 maintained constant by a retainer 25 slidably fitted around the spherical seat 21.

On the other hand, in the other end portions of the respective bores 14, there are fitted a plurality of bushes or bushings 28 each consisting of a thin-walled cylinder portion 26 which can make tight contact with an inner wall surface of the bore 14 as expanded in diameter by a high-pressure liquid within the bore 14 and a flange portion 27 which butts against the seal plate 19. Between an urging plate 29 positioned between these flange portions 27 of the bushes 28 and one end surface of the cylinder block 15 and butting against the respective flange portions 27, and the cylinder block 15, is interposed a compression coil spring 30 for bringing the flange portions 27 of the bushes 28 into tight contact with the seal plate 19 in cooperation with the high-pressure liquid within the bores 14. It is to be nted that the compression coil spring 30 also has a function of urging the shoes 23 against the tilt-plate 22. However, by replacing a compression coil spring for a spacer 31 interposed between the cylinder block 15 and the spherical seat 21, the function of the compression coil spring 30 can be limited to the action of improving the tight contact property between the seal plate 19 and the bushes 28. In addition, since the bushes 28 has a structure adapted to be individually fitted in the bores 14, the precision of fitting between these members can be made high, and so, the gap clearance therebetween can be narrowed as compared to the prior art structure.

In the event that the cylinder block 15 and the seal plate 19 should be tilted relative to each other, the thin-walled cylinder portion 26 would elastically bend and deform while being in tight contact with the inner wall surface of the bore 14, and hence there would be no fear that the contact surfaces of the flange portion 27 and the seal plate 19 may be separated. In addition, since the gap clearance between the inner wall surface of the bore 14 and the outer wall surface of the thin-walled cylinder portion 26 is sealed by the thin-walled cylinder portion 26 being expanded in diameter by a high-pressure liquid within the bore 14, the sealing function could be enhanced by further thinning a wall surface in one part of the thin-walled cylinder portion 26 as shown in FIG. 3, which illustrates, in cross-section, a structure of a bush according to yet another preferred embodiment of the present invention.

Figure 2B:
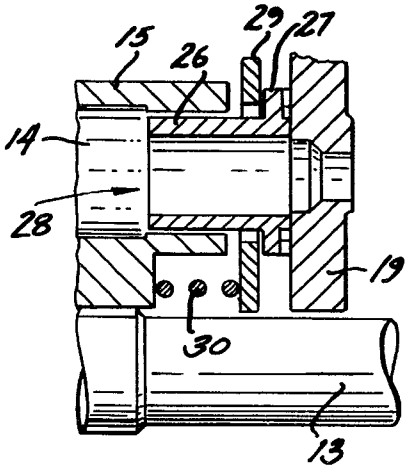
Figure 2A:
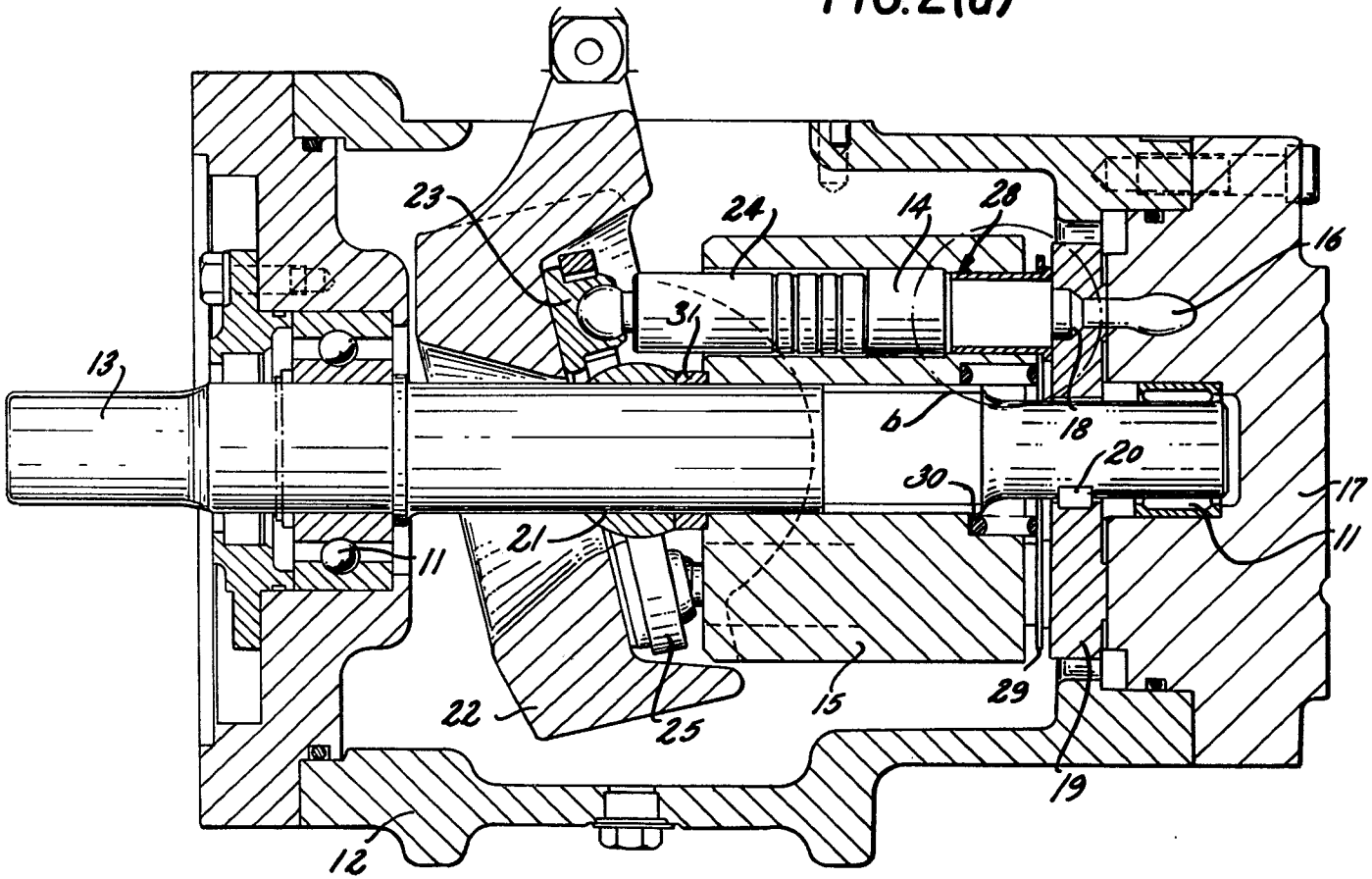

In FIG. 2(*b*), the bush 28 is applied with a pressure of the high-pressure liquid within the bore 14 from the left side thereof. Also, it is applied with a pressure which appears as a negative pressure at a seal land portion (not shown) of the seal plate 19 from the right side thereof, and further it is indirectly applied with a contact pressure with the valve plate 17. Accordingly, sealing between the seal plate 19 and the flange portion 27 can be achieved by designing them so that the force applied from the left side may be always larger than the force applied from the right side, and this is similar to the method for bringing the slide contact surfaces of the shoes 23 into tight contact with the tilt-plate 22. In the case where the difference between the force applied from the left side and the force applied from the right side is small, as the bushes 28 are liable to be subjected to external disturbances, it is preferable to forcibly bring the flange portions 27 of the bushes 28 into tight contact with the seal plate 19 by means of the compression coil spring 30, as is the case with the above-described embodiment.

In this case, as shown in FIG. 4, in place of the single compression coil spring 30, a plurality of compression coil springs 32 could be individually interposed between the flange portion 27 of each bush 28 and the cylinder block 15 and thereby the urging plate 29 could be omitted as it is in FIG. 4, which illustrates a structure for mounting a bush 28 according to still another preferred embodiment of the present invention. In this instance, it is preferable to replace the above-described spacer 31 by a compression coil spring.

Moreover, practically it is possible to achieve sealing only by the pressure difference even if the compression coil spring or springs 30 or 32 are not employed, and in this case, as shown in FIG. 5, the urging plate 29 could be fixedly secured to the seal plate 19 via spacers 34 which are somewhat thicker than the thickness of the flange portion 27 as by means of bolts 33. FIG. 5 illustrates a structure for mounting a bush 26 according to a still further preferred embodiment of the present invention. In this instance, if the thickness of the spacers 34 is chosen thinner than the thickness of the flange portion 27 to assure an interference, then owing to a spring action of the urging plate 29, the bushes 28 are kept in tight contact with the seal plate 19. Alternatively, the spacers 34 can be formed integrally with the seal plate 19.

In place of the bolts 33 used in the modified embodiment shown in FIG. 5, compression coil springs 36 could be employed, as shown in FIG. 6. In order to prevent the spacers 34 from slipping out of the gap between the seal plate 19 and the urging plate 29 due to a centrifugal force generated as a result of rotation of the rotary shaft 13, the spacers 34 are mounted to spindles 35 extending through the urging plate 29, and the urging plate 29 is urged against the spacers 34 by compression coil springs 36 via the spindles 35. FIG. 6 illustrates a structure for mounting a bush 26 according to still another preferred embodiment of the present invention. In this case, similarly to the previously described embodiment, the thickness of the spacers 34 is designed to be equal to or somewhat thicker than the thickness of the flange portion 27.

Since bending deformation would arise in the bushes 28, in order to absorb such bending deformation, there is shown in FIG. 7 a spherical seat 37 formed in the flange portion 27 of the bush 28. An annular seal protrusion 38, adapted to be slidably engaged with this spherical seat 37, is provided around the bore 18 in the seal plate 19. FIG. 7 illustrates a structure for mounting a bush 26 according to yet another preferred embodiment of the present invention. Even if the cylinder block 15 and the seal plate 19 should tilt relative to each other, since the seal protrusion 38 on the seal plate 19 and the spherical seat 37 in the bush 26 form a sliding pair, these members make tight contact with each other and thereby it is possible to realize excellent sealing.

As described in detail above, in the axial plunger pump or motor according to the present invention, since a seal plate in the prior art which is interposed between a valve plate and a cylinder block and which has cylinder portions projected in an annular shape, has cylinder portions separated, a machining precision for the cylinder portions can be greatly enhanced, and moreover, since the thin-walled cylinder portions make tight contact with the inner wall surfaces of the bores as expanded in diameter by a high-pressure liquid and also the cylinder portions are subjected to elastic bending deformation with their flange portions kept in tight contact with the seal plate, even if the seal plate and the cylinder block should tilt relative to each other, there would be no fear that the sealing property between the flange portions and the seal plate may be degraded.

Since many changes could be made in the above construction and many apparently widely different embodiments of this invention could be made without departing from the scope thereof, it is intended that all matter contained in the above description or shown in the accompanying drawings shall be interpreted as illustrative and not as a limitation to the scope of the invention.

What is claimed is:

1. An axial plunger pump or motor in which a valve plate having a suction port and a discharge port drilled therein is fixed to a casing in which a rotary shaft is mounted, a cylinder block having one end surface opposed to said valve plate is coupled to said rotary shaft, a plurality of bores whose one ends can be communicated with said suction port and discharge port are drilled in said cylinder block in parallel to said rotary shaft, a plurality of plungers which can reciprocate within said respective bores in accordance with rotation of said rotary shaft are slidably fitted in said bores on the side of the other ends, and a seal plate positioned between said valve plate and said cylinder block and making slide contact with said valve plate is coupled to said rotary shaft, wherein the improvement comprises:

a plurality of bushings, each including a thin-walled cylinder portion fitted in one end portion of each of said plurality of bores and capable of making tight contact with the inner wall surface of each of the bores when expanded in diameter by a high-pressure liquid within said bores and further including a flange portion butting against said seal plate, interposed between said seal plate and said cylinder block, an urging plate means for bringing the flange portion of said bush in tight contact with the seal plate in cooperation with the high-pressure liquid, provided between the flange portion of said bush and said one end surface of the cylinder block, spacers provided in a gap between the seal plate and the urging plate means; and means for preventing the spacers from slipping out of the gap.

2. The axial plunger pump or motor according to claim 1 wherein:

said preventing means is a plurality of bolts connecting the urging plate means with the seal plate.

3. The axial plunger pump or motor according to claim 1 wherein:

said preventing means is a plurality of compression coil springs fitted in said one end surface of the cylinder block and a plurality of spindle means, extending through the urging plate means, for mounting the compression coil springs thereon.

* * * * *